US005834127A

United States Patent [19]

Baerenwald et al.

[11] Patent Number: 5,834,127

[45] **Date of Patent: *Nov. 10, 1998**

[54] INFORMATIVE CARD MADE OF SHEET METAL

[75] Inventors: Philip M. Baerenwald, Rockton; Alfred L. Gray, Belvidere; Michael A. Yarbro, Rockford, all of Ill.

[73] Assignee: J. L. Clark, Rockford, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 633,464

[22] Filed: Apr. 17, 1996

[51] Int. Cl.[6] ..... B42D 15/02; B21D 53/00

[52] U.S. Cl. ..... 428/595; 428/599; 40/124.01; 72/379.2

[58] Field of Search ..... 428/595, 582, 428/599, 14; 40/124.01, 791; 206/453; 72/379.2

[56] References Cited

U.S. PATENT DOCUMENTS

| | | | |
|---|---|---|---|
| 625,815 | 5/1899 | Thawley | 40/617 |
| 708,628 | 9/1902 | Elliott | 40/649 |
| 782,199 | 2/1905 | Keplinger | 40/772 |
| 1,117,085 | 11/1914 | Potts | 40/124.17 |
| 1,456,845 | 5/1923 | Fuller | 72/379.2 |
| 1,548,507 | 8/1925 | Brown | 273/317.9 |
| 1,575,720 | 3/1926 | Scott | 40/701 |
| 1,607,465 | 11/1926 | Kirk et al. | 40/793 |
| 1,700,943 | 2/1929 | Lesser | 40/584 |
| 1,710,483 | 4/1929 | Kraushar | 40/726 |
| 1,749,148 | 3/1930 | McGregor | 72/379.2 |
| 1,790,665 | 2/1931 | Hubbard | 101/368 |
| 1,924,429 | 8/1933 | Winzeler | 41/24 |
| 2,113,871 | 4/1938 | Bozung | 40/154 |
| 2,695,470 | 11/1954 | Rosenberg et al. | 40/152 |
| 2,871,600 | 2/1959 | Woodruff | 40/152 |
| 3,322,299 | 5/1967 | Foster | 220/60 |
| 4,291,798 | 9/1981 | Transport | 206/45.24 |
| 4,309,835 | 1/1982 | Naeve | 40/310 |
| 4,515,838 | 5/1985 | Miyajima | 428/14 |
| 5,097,953 | 3/1992 | Gingras | 40/791 |
| 5,215,792 | 6/1993 | Miller | 428/14 |
| 5,363,964 | 11/1994 | Hexter, Jr. | 206/449 |
| 5,538,135 | 7/1996 | Hexter | 206/449 |
| 5,577,609 | 11/1996 | Hexter | 40/791 |

*Primary Examiner*—John J. Zimmerman
*Attorney, Agent, or Firm*—Leydig, Voit & Mayer, Ltd.

[57] ABSTRACT

An informative card, such as a baseball trading card, has a rectangular shape and is made of a single thin sheet of metal in such a way that it is free of pointed corners or exposed raw edges. The informative card has four rounded corners and a double-thickness frame defined by a folded lip which has four straight edges and four rounded connectors joining the straight edges at the corners. The folded lip provides an unbroken radiused peripheral edge bordering the card. A central display panel of the card is offset rearwardly to form a raised ledge on the front side of the card surrounding the central display panel.

13 Claims, 6 Drawing Sheets

INFORMATIVE CARD MADE OF SHEET METAL

FIELD OF THE INVENTION

This invention relates generally to informative cards, such as baseball trading cards, and more particularly to informative cards made of sheet metal.

BACKGROUND OF THE INVENTION

Baseball card trading, like baseball itself, has been a part of American culture, and baseball cards are treasured collections and valuable commodities of not only many children but many adults alike. A baseball trading card typically displays a photograph of a baseball player on the front side, and career statistics or other data of the player are usually printed on the back of the card. Conventionally, baseball trading cards are made of paperboard or other paper-like material. The obvious drawback of paper cards is that they do not endure repeated shuffling and handling, and are damaged easily.

Recently, baseball trading cards made of sheet metal are becoming increasingly popular. One of the reasons for their popularity is, of course, that they are much more durable than paper cards and therefore are more "permanent." Another reason for their popularity is that the workability of metal allows the metal cards to be shaped, such as by embossing, to create visual effects not easily achievable on paper cards. For example, U.S. Pat. No. 5,215,792 to Miller and assigned to the same assignee of the present invention discloses such an informative card made of a single sheet of metal. The four edge portions of the informative card comprise hems folded on the rear side of the card. The front side of the card contains a central display region which is offset slightly towards the rear so as to leave a raised peripheral ledge framing the central display region. The resultant card is similar to conventional paperboard baseball cards in thickness but has a more attractive appearance. Because the edges of the card are folded, the metal information card is generally free of sharp edges and sharp points. However, a short length of the raw edge of the sheet metal remains at each corner of the card, and such raw edges, albeit very short, may still cause safety concerns.

It has also been proposed to make baseball cards with a combination of metal and paper. For example, U.S. Pat. No. 5,363,964 to Hexter discloses a baseball trading card having a metal substrate holding a printed cardboard insert in the front. The four edge portions of the metal substrate are rolled towards the printed cardboard such that the metal edges grip the cardboard and hold it in position. A significant disadvantage of such a paper/metal trading card is that it is several times thicker than conventional paper baseball cards due to its thick rolled edges. Thus, the paper/metal trading card does not look like a conventional baseball trading card but, rather, resembles a miniature framed picture. The paper/metal trading card also cannot be shuffled like a conventional trading card. Such deviation from the look and feel of conventional baseball trading cards makes the paper/metal trading cards undesirable to many collectors. Another disadvantage of such a card is its relatively high cost because each card requires both a printed cardboard elements and a formed metal sheet.

SUMMARY OF THE INVENTION

In view of the foregoing, it is a primary object of the present invention to provide a metal informative card which resembles a conventional baseball trading card but has an enhanced appearance, and has no raw edges or sharp corners so that it is substantially safe to handle.

A further object is to reduce or substantially eliminate raw edges capable of snagging, so that the metal cards can be handled much like conventional cardboard informative cards.

It is a related object of the present invention to provide an informative card made of a single sheet of metal formed in a way which eliminates raw edges and sharp corners without substantially increasing the thickness of the card.

Yet a further object is to provide such a card that is easy to manufacture and therefore of low production cost.

According to these and other objects of the present invention, there is provided an informative card made of sheet metal that has a front side, a rear side, four rounded corners, and a double-thickness frame formed of a folded lip pressed against the rear side. The lip is continuing at the periphery of the card, and includes four straight edges and four rounded connectors joining the straight edges at respective rounded corners. The rounded connectors have a smaller dimension than the straight edges, and the card is formed in such a way and that when the lip is folded against the back of the card, it forms a frame which is substantially free of gaps or bunching at the corners.

It is a feature of the present invention that the metal informative card has no sharp corners or exposed raw edges. The folded lip, being unbroken along the periphery of the card, provides a continuous radiused peripheral edge which is intended not to cut the hand of a consumer, or to snag on other cards or other objects.

Other objects and advantages will become apparent with reference to the following detailed description when taken in conjunction with the drawings in which:

Figure 2:
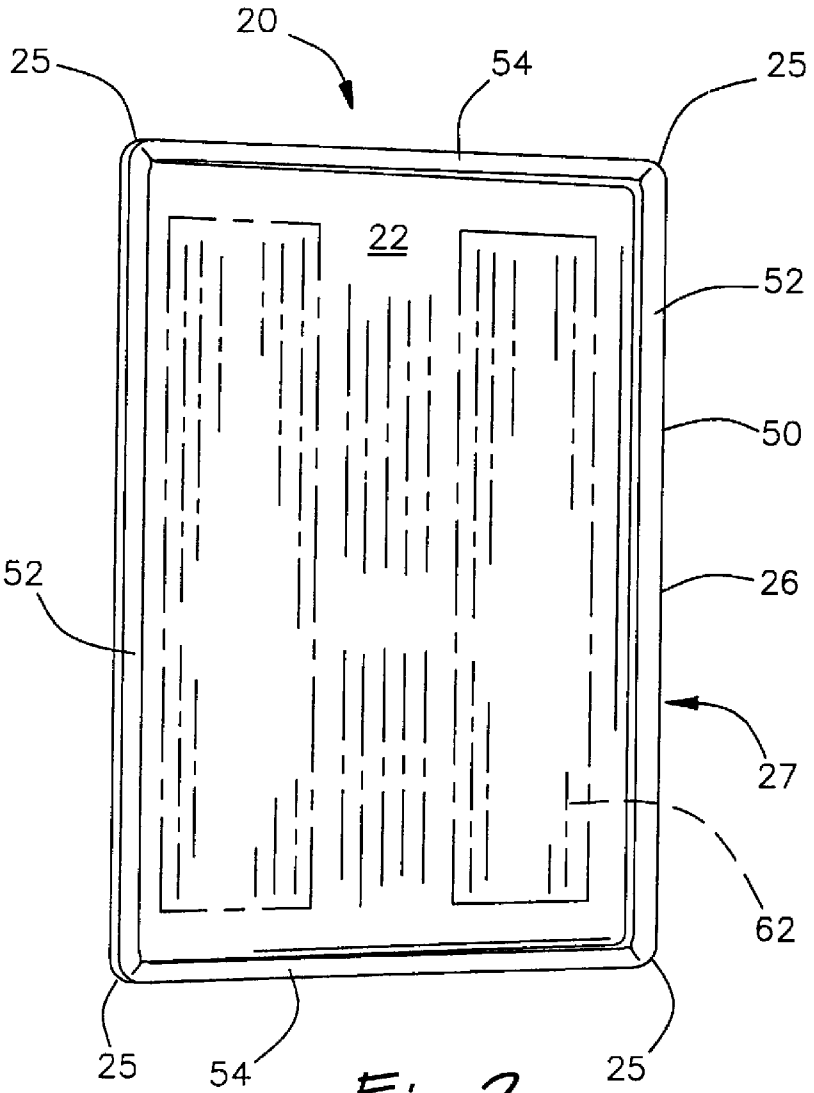
FIG. 2 is a rear perspective view of the metal informative card with printed material on the rear side.

While the invention is susceptible of various modifications and alternative constructions, certain illustrated embodiments hereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENT

Turning now to the drawings, for purposes of illustration the invention has been shown in the drawings as embodied in a baseball trading card. It will be appreciated, however, that other types of images or information can be printed on the card, and, indeed, the card of the present invention may have a size different from that of a conventional baseball trading card, depending on the use of the card.

Figure 1:
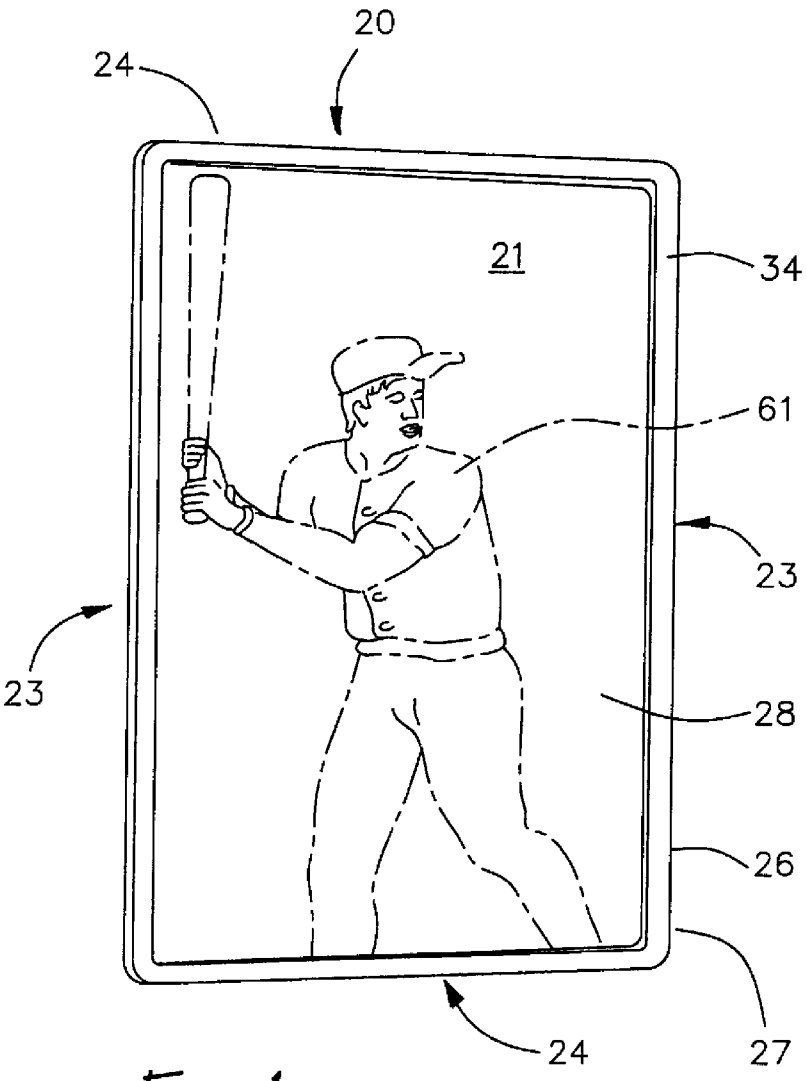
FIG. 1 is a front perspective view of a metal informative card constructed according to the present invention and carrying a picture of a baseball player.
Figure 3:
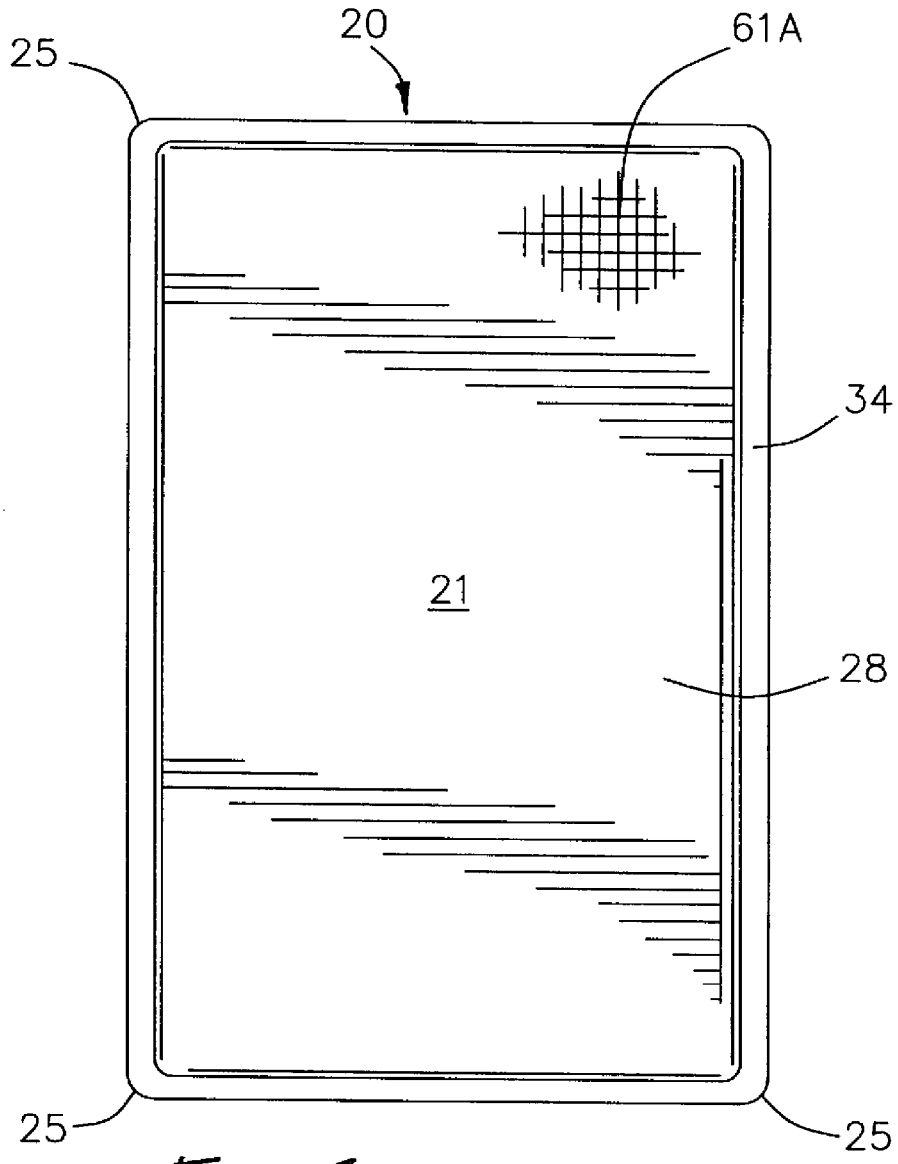
FIG. 3 is a front elevation of the card with printed material not shown.
Figure 4:
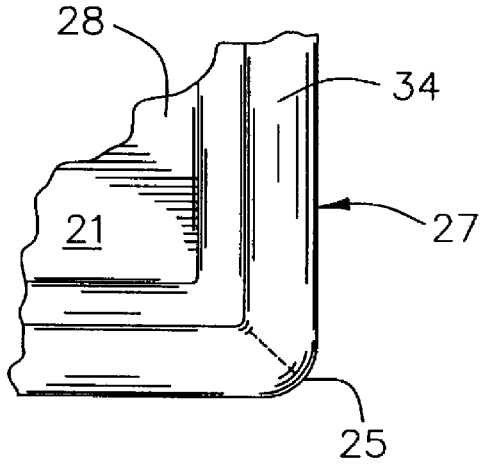
FIG. 4 is an enlarged front view of one corner of the card.
Figure 5:
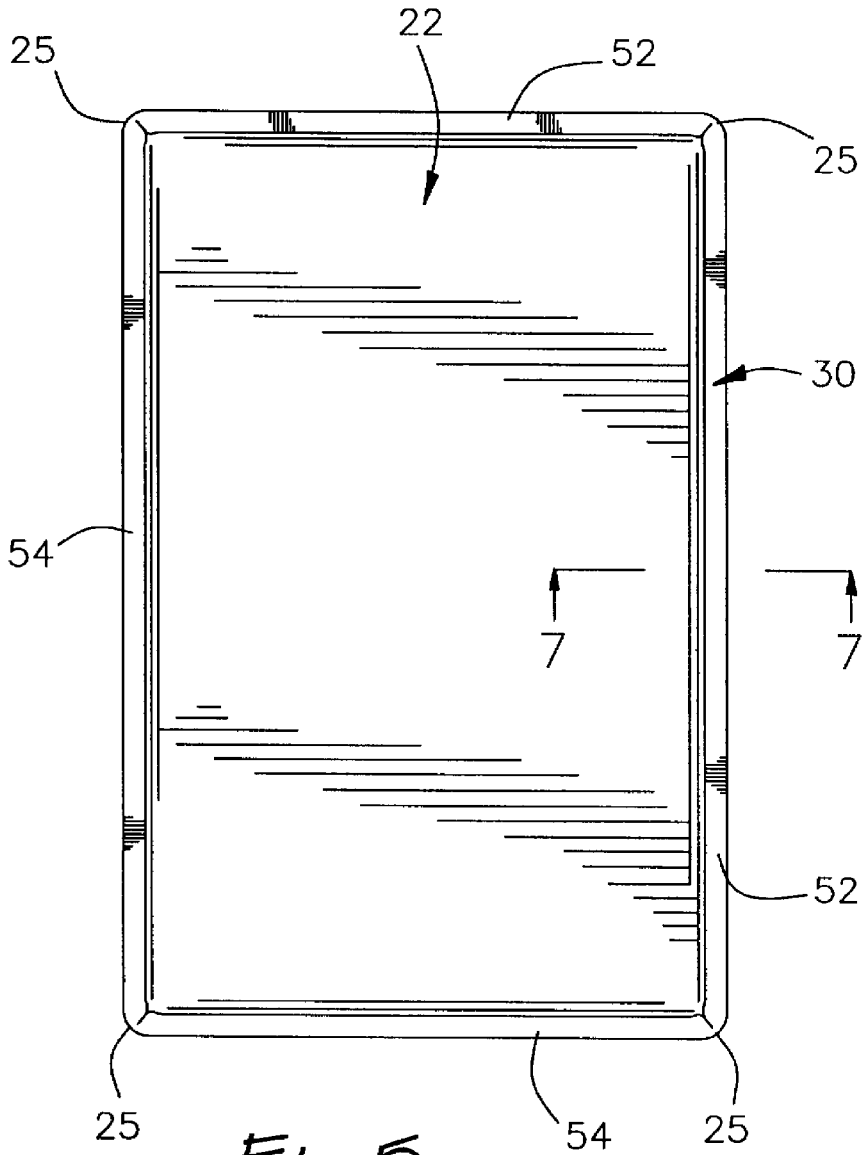
FIG. 5 is a rear elevation of the card.

FIG. 1 shows, in a perspective view, the front side 21 of a metal informative card 20 embodying the present invention. The card 20 is generally flat and has a rectangular shape, with two long edge portions 23 and two short edge portions 24 extending at right angles to the long edge portions. Exemplifying the practice of the present invention, a photograph 61 of a baseball player is printed on the front side 21 of the card. The rear side 22 of the card is shown in FIG. 2. As is conventional for baseball trading cards, printed material 62 showing career statistics of the player or other information is printed on the rear side. Preferably the card 20 has the size of a conventional baseball trading card, with a length of 3.5" and a width of 2.5". Front and rear elevations of the card 20 with printed material deleted are shown in FIG. 3 and FIG. 5 respectively.

To provide additional attractive and decorative features, particularly suited to a metal trading card, the card 22 can have embossed regions which cooperate with the printed image, as desired. For example, the name of the team can be embossed, the image of the player can be embossed, a glove can be embossed, or the like. For purposes of illustration, a small section 61A is defined on card 21 in FIG. 3 to represent an embossed area. Preferably the embossing is accomplished at the time the card blank is cut from a larger sheet of card blanks.

Figure 6:
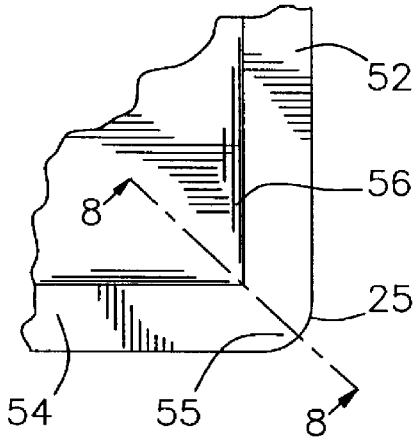
FIG. 6 is an enlarged rear view of one corner of the card.

It is an important feature of the present invention that the informative card 20, which is made of a single sheet of metal, has no sharp corners or exposed raw edges. As shown in FIGS. 3–6, all four corners 25 of the card are rounded, and the entire peripheral edge 26 is an unbroken continuous rounded section with no exposed raw edge. As can be best seen in the cross-sectional views of FIGS. 7 and 8, the card is bordered by a frame 27. The frame 27 is defined by a lip 50 which, after formation, is folded and pressed against the rear side 22 of the card such that the thickness of the frame 27 is about twice the thickness of the metal sheet forming the card 20. Referring now to FIGS. 5 and 6, the lip 50 includes two long parallel edges 52 and two shorter parallel edges 54 which are perpendicular to the long edges, and four connectors 55 at the rounded corners 25 of the card joining the straight edges of the lip. As shown in FIG. 6 and the enlarged cross-sectional view of FIG. 8, the connectors 55 have a smaller dimension than the straight edges 52 and 54. However, each of the connectors has sufficient material so that the folded lip 50 is continuous and unbroken around the corners 25.

Figure 7:
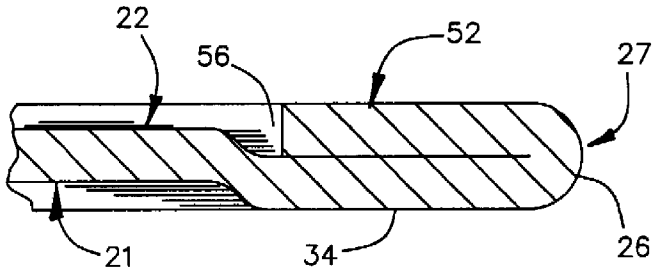
FIG. 7 is an enlarged fragmentary cross-sectional view of the card along the line 7—7 in FIG. 5.
Figure 8:
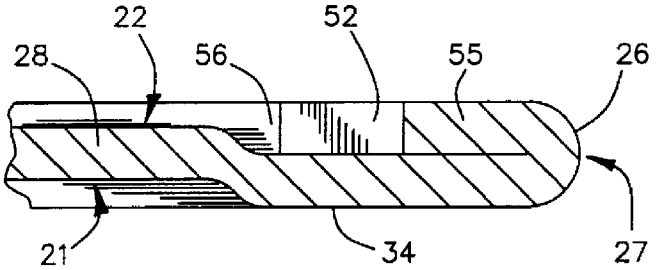
FIG. 8 is an enlarged fragmentary cross-sectional view of the card along the line 8—8 in FIG. 6.
Figure 9B:
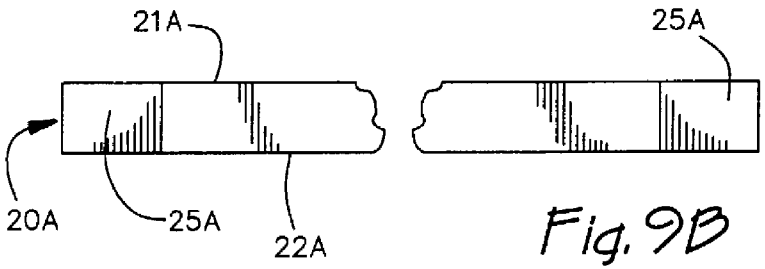

By virtue of the folded lip 50, the card 20 has a radiused peripheral edge 26, as can be best seen in FIGS. 7 and 8, which is unbroken along the entire periphery of the card. The combination of an unbroken radiused edge 26 and the rounded corners 25 provides a smooth edge surface that is intended not to cut the hand of a consumer or snag on other cards, clothing or the like. The formation of such an edge renders the card substantially safe for handling. Combined with the relative thinness of the card, even considering the double thickness frame, this construction enhances convenience, and allows the cards to be stacked and handled much like conventional cardboard cards. It will be appreciated that the elimination of sharp corners and raw edges is achieved in the present invention without significantly increasing the thickness of the card. Thus, the metal card of the illustrated embodiment has the general look and feel of a conventional baseball trading card.

To further enhance the appearance of the metal card, in the illustrated embodiment in FIG. 1 a rectangular central display panel 28 inboard of the frame 27 is offset rearwardly relative to the frame by about half the thickness of the sheet metal forming the card. As can be best seen in FIG. 7, the rearward displacement of the display panel 28 forms a raised ledge 34 on the front side 21 and a sunken recess 56 on the rear side 22 along the lip 50. The inboard portion of the ledge 34 is located along and opposite to the recess 56 on the rear side. As illustrated in FIG. 1, the raised ledge 34 forms a continuous border attractively framing the central display panel 28. Accordingly, the photograph 61 on the front side 21 is highlighted by the continuous raised ledge 34 to a greater degree than is the case when a border of contrasting color is simply printed on a flat substrate, as is common on paperboard baseball trading cards.

A further advantage of offsetting the central display panel 28 is that the sunken recess 56 thus created accommodates part of the thickness of the lip 50. As a result, the lip 50 projects from the rear side 22 of the card by only about half the thickness of the sheet metal. The edges of the lip 50 are therefore not likely to cut fingers. As illustrated in FIG. 2, the lip 50 also serves as a raised border framing the printed material 62 on the rear side of the card.

The preferred process for forming the metal informative card will now be described. The informative card is formed from a sheet metal blank 20A having a flat body 29A which is generally rectangular with four straight raw edges. In one embodiment the blank 20A preferably has a length of about 3.612", a width of 2.612", and a thickness of 0.009". The shape of the blank has relieved corners 25 formed in stamping or cutting the sheet, for purposes soon to be described.

It will be noted that a large sheet of metal is printed with a large number of repeat images of the card, and the large sheet is then subjected to a blanking operation in which the individual blanks 22A (FIG. 9A) are cut from the large sheet. Typically the blanking operation simply uses a complimentary set of dies having mating peripheral sections shaped like the blank exterior of FIG. 9A. However, in the case where it is also desired to emboss the card, the blanking operation provides a convenient opportunity for also accomplishing the embossing. In the case where embossing is to be provided, the blanking dies, in addition to forming the periphery of the blank, will also carry the image to be embossed, so that the impact between the mating dies in the blanking operation will also form the embossed image.

Figure 9A:
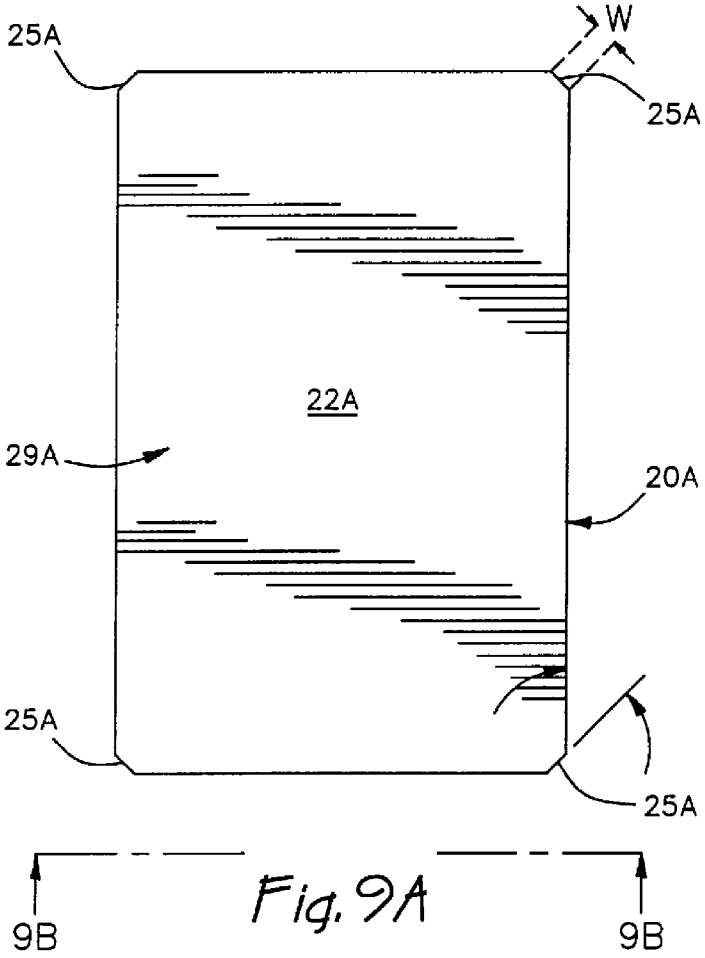
FIGS. 9A and 9B show, respectively, rear and end views of a sheet metal blank from which the informative card is formed.

Returning to the shape of the cards, as illustrated in FIG. 9A, each of the four corners 25A is not a right angle but is cut away so as to slope at about a 45 degree angle with respect to the adjacent raw edges of the blank. The angle can be adjusted as required to suit the material thickness and material decoration. The width of the angled section, denoted W, is important. If the width is too small, significant bunching and crumpling can result at the corners of the formed card 20. On the other hand, if the width is too large, there will not likely be sufficient material left to form the connectors 55 (FIG. 6) at the corners 25, and the resultant card would not have an unbroken radiused peripheral edge 26 around the corners. With the preferred dimensions of the metal blank 20A, the width of the angled section may generally be in the range of 0.100" to 0.140", and in the currently preferred embodiment is about 0.107".

Figure 10B:
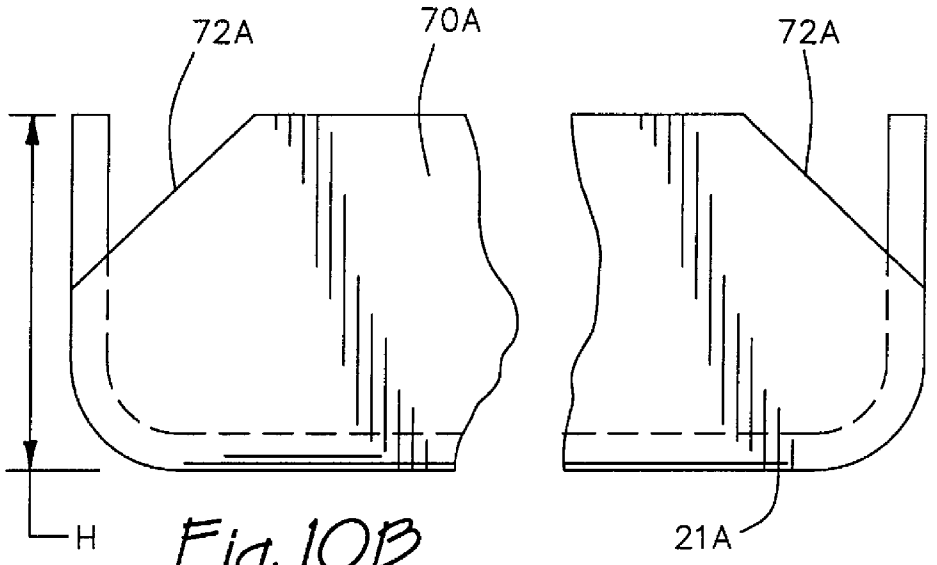
FIGS. 10A and 10B show, respectively, rear and end views of the sheet metal blank after a drawing step in making the card.
Figure 10C:
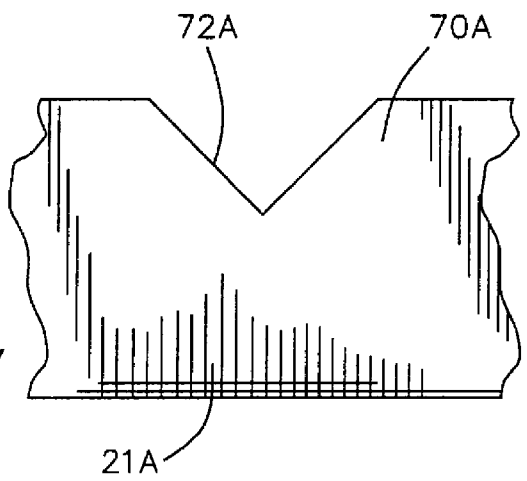
FIGS. 10C is a partial elevation detailing the notched lip at the corner prior to bending and folding.
Figure 10A:
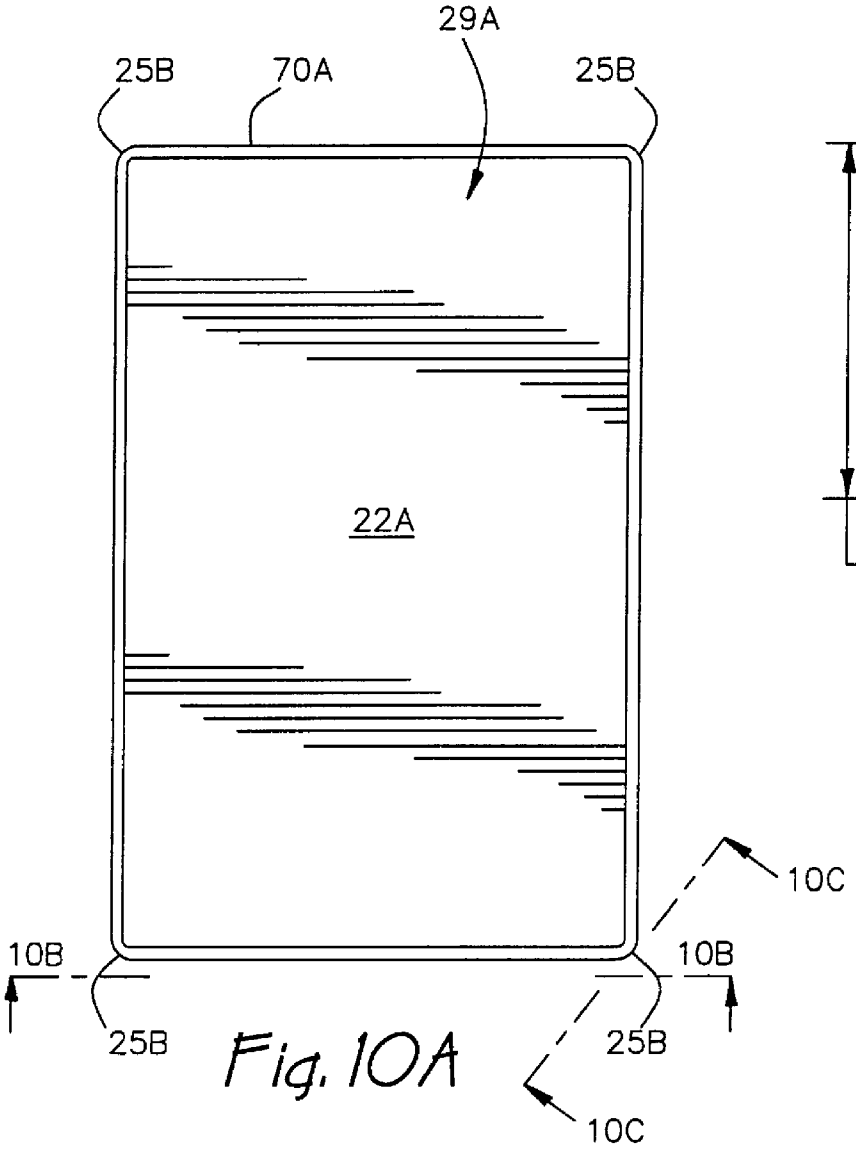

To form the informative card, the blank 20A first is drawn to shape the margins of the blank 20A, thereby forming into an upstanding flange 70A projecting in toward the rear of the card. Drawing is accomplished by the action of implementary dies which force the metal sheet into a female die, forming the upstanding lip between adjacent sections of male and female dies. The resultant piece is shown in FIG. 10A, and the flange 70A can be best seen in the end view of FIG. 10B. The drawing process works the metal to form rounded corners 25B on the body 29A. In one embodiment, the corners preferably have a radius of curvature of about 0.062". After the drawing process forms the upstanding lip, the blank 20A has the size of a conventional baseball trading card, approximately 3.5" in length and 2.5" in width. The height of the flange 70A, denoted H, is about 0.078", measured from the front surface 21A of the blank. As shown in FIG. 10B, the flange 70A has a generally V-shaped recess 72A at each of the rounded corners 25B, but remains unbroken along the periphery of the drawn blank. The generally V-shaped recesses are formed by deforming the 45 degree sections 25A of the blank in the drawing process. It must be appreciated in viewing FIG. 10B that the V-shaped groove extends around the corner of the card, joining the mutually perpendicular long and short sides of the lip as is suggested in FIG. 10C. In effect, the V-shaped recesses provides a connector for the rounded corner which has a dimension which is less than the dimension of the lip at the straight sides. In the case where the height of the flange adjacent the straight edges is on the order of 0.078 inches, the height of the flange at the corners ranges from about 0.030 inches at the notch of the V approximately intermediate the corner and fairing upward to join the full height flange at the mutually perpendicular sides. The reduced dimension in the corner, achieved by the basic cut corners 25A of the card and the drawing process provides enough material in the corner to make a continuous frame, when the lip is bent down against the rear of the card, but without so much material as to cause bunching in the corner. The dimension W of the basic cut, the depth to which the card is drawn and the thickness of the material which forms the card are all coordinated such that the finished formed card has a neat and continuous frame around the periphery thereof, without bunching or gaps at the corners.

Figure 11A:
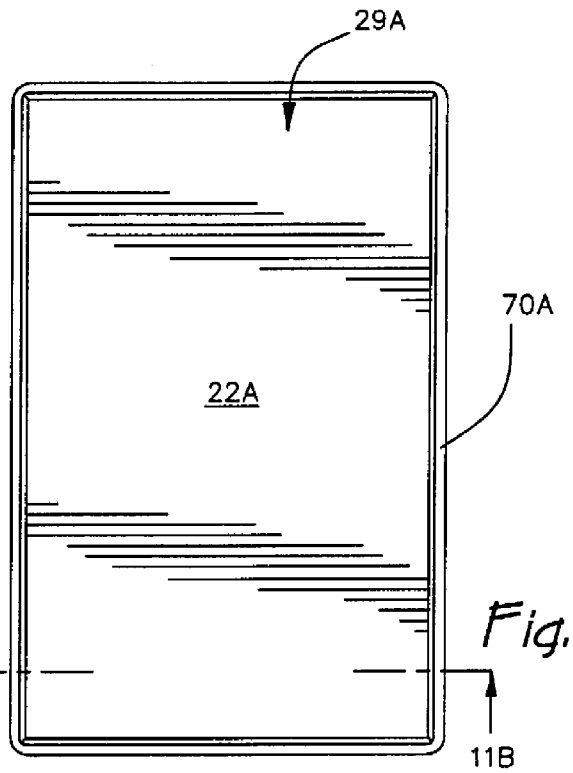
FIGS. 11A and 11B show, respectively, rear and cross-sectional views of the sheet metal blank after a subsequent bending step.
Figure 11B:
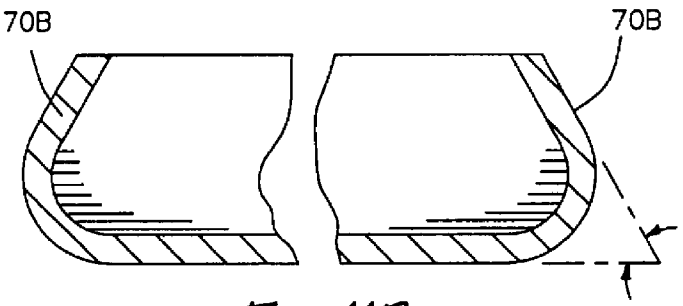

To facilitate the folding of the flange 70A towards the rear side 22A of the blank to form the lip 50, the flange 70A is overbent to a selected angle with respect to the rear side. In the illustrated embodiment in FIGS. 11A and 11B, this bending step bends the flange such that the overbent flange 70B forms an angle of about 60 degrees with the rear side 22A of the body 29A. overbending is accomplished without bending the metal at the corners 25A of the card. The overbending step begins to form the curls which will provide the radiused edges of the card, and is particularly significant in the context of the present card where the upstanding lip is continuous after the drawing step. In effect, after the drawing step the blank is in the shape of a pan having a continuous rim, but in which the height of the rim at the corners is less than the height along the straight edges.

By performing the overbending step, the edge of the flange is displaced inwardly, so that the tool which is subsequently used to flatten the hem and form the frame is capable of engaging the leading edge of the lip and displacing it in an arcuate fashion downwardly to meet the rear of the card without the possibility of buckling the lip which forms the frame. This is particularly significant in the corners where the shape of the relieved section is such as to maintain the continuity the lip right at the edge, but join the metal at the inward part of the frame to form a continuous double thickness section which is filled with metal from the edges in such a way as to substantially eliminate both gaps and bulges.

Figure 12A:
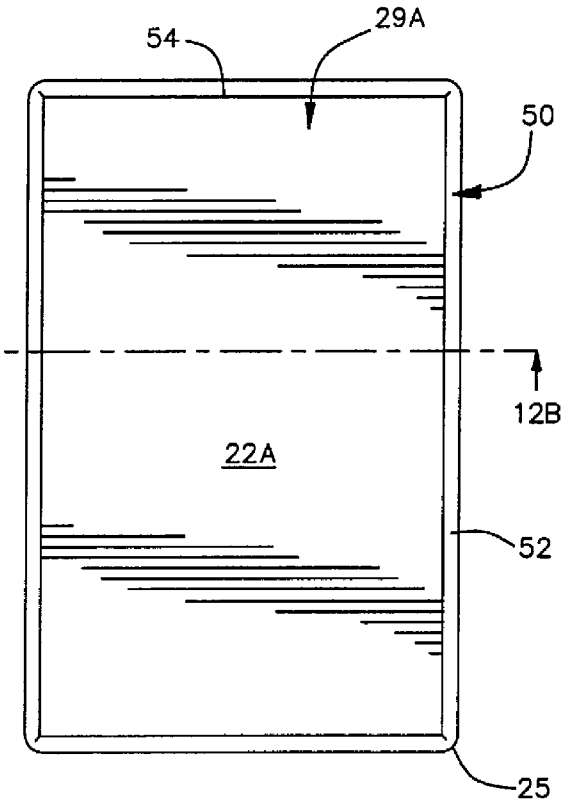
FIGS. 12A and 12B show, respectively, rear and cross-sectional views of the sheet metal blank after a subsequent flattening step.
Figure 12B:
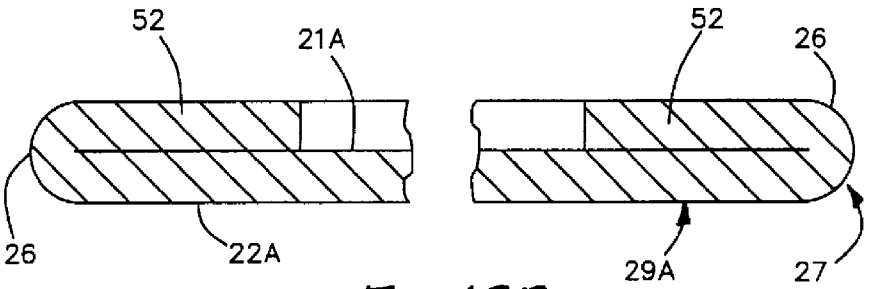

The overbent flange 70B is then flattened against the rear side 22A to form the lip 50. The processed blank resulting from this step is illustrated in FIGS. 12A and 12B. After the flattening step, the straight edges 52 and 54 of the lip 50 has a width of about 0.062". The frame 27, which includes the folded lip 50 and the portion of the body 29A facing the lip, has a thickness of about 0.019". Because the connectors 55 (FIG. 6) have a smaller dimension than the straight edges, any overlapping of metal at the corners 25 caused by folding the flange 70B down is relatively insignificant, and the entire lip, corners included, is readily flattened in this step to a relatively uniform double thickness.

As illustrated in the cross-sectional view of FIG. 12B, at this intermediate stage the front side 21A of the blank remains flat, and the full thickness of the lip 50 remains exposed. If desired, the blank as processed may be used as an informative card. However, as described above, it is preferable to displace the portion of the body 29A inboard of the lip 50 rearwardly to create the raised ledge 34. To this end, an offsetting step is performed in which the central display panel 28 is pressed rearwardly relative to the frame 27 by a small distance, preferably about half the thickness of the original metal blank. The card as completed is illustrated in FIGS. 1–8.

It will be appreciated that what has been provided includes a new and improved metal informative card which is completely free of sharp corners and exposed raw edges, and a method for making such a card. The card has a double-thickness frame formed of a folded lip, and an unbroken radiused edge along the entire periphery of the card. The front and rear sides may be attractively lithographed. Enhanced appearance is achieved by offsetting the central display panel relative to the frame to form a ledge on the front side which defines an uninterrupted border attractively framing the central display panel.

What is claimed is:

1. An informative card of a rectangular shape made of a substantially flat and generally rectangular thin metal sheet, the informative card having a front side, a rear side, four rounded corners, a double-thickness frame formed of a folded lip pressed against the rear side, and indicia on the front side of the card, the lip including four straight edges and four rounded connectors joining the straight edges at respective rounded corners, the rounded connectors having a smaller dimension than the straight edges to form a frame which is substantially free of gaps or bunching at the corners.

2. An informative card according to claim 1, wherein a central display panel inboard of the frame is offset rearwardly relative to the frame to from a raised ledge on the front side and a sunken recess on the rear side along the frame, the raised ledge defining a continuous border framing the central display panel.

3. An informative card as in claim 2 wherein the card is about 3.5 inches long and about 2.5 inches wide.

4. An informative card as in claim 3 wherein the thin metal sheet is on the order of 0.009 inches.

5. An informative card as in claim 4 wherein a length of the lips at the four straight edges is about 0.08 inches, and a length of the lip at the corner decreases to about 0.04 inches or less, such that the lip joins to form a continuous frame substantially free of gaps or bunching at the corners.

6. An informative card as in claim 1 wherein the indicia includes an embossed area.

7. An informative card of a rectangular shape made of a substantially flat and generally rectangular metal sheet, the informative card having a front side, a rear side, four rounded corners and a double-thickness frame formed of an unbroken flange drawn from margins of the metal sheet and folded onto the rear side and pressed flat to form an unbroken radiused peripheral edge.

8. An informative card according to claim 7, wherein a central display panel inboard of the frame is offset rearwardly to form a raised ledge on the front side continuously bordering the central display panel and a sunken depression on the rear side along the frame.

9. An informative card according to claim 7, wherein the central display panel carries a printed indicia.

10. An informative card according to claim 7, wherein the central display panel carries an embossed indica.

11. A method for producing a metal informative card comprising the steps of:

providing a substantially flat and generally rectangular sheet of metal having front and rear sides, four straight raw edges and four relieved corners each having a sloped section forming a 45 degree angle with adjacent straight raw edges;

drawing the sheet of metal to form an unbroken upstanding flange at the edges of the sheet projecting rearwardly, the flange being rounded at the corners of the sheet and having a height at the rounded corners which is less than the height at the straight sides joining the corners;

bending the flange towards the rear side;

flattening the flange to form a folded lip pressed against the rear side of the sheet of metal, the folded lip defining a double-thickness frame substantially free of gaps or bunching at the corners, and an unbroken radiused peripheral edge.

12. A method as in claim 11, further including the step of offsetting rearwardly a central display panel inboard of the frame to form a continuous raised ledge on the front side surrounding the central display panel.

13. A method as in claim 12, further including the step of embossing an indicia in the central display panel to form a raised image.

* * * * *